United States Patent [19]

Guggemos et al.

[11] Patent Number: 4,497,451

[45] Date of Patent: Feb. 5, 1985

[54] PNEUMATIC DRIVE FOR A SWINGABLE SPOOL HOLDER

[75] Inventors: Hans Guggemos, Peterthal; Rolf-Dieter Weber, Kempten, both of Fed. Rep. of Germany

[73] Assignee: Saurer-Allma GmbH, Kempten, Fed. Rep. of Germany

[21] Appl. No.: 520,103

[22] Filed: Aug. 4, 1983

[30] Foreign Application Priority Data

Sep. 28, 1982 [DE] Fed. Rep. of Germany ..... 3235789

[51] Int. Cl.[3] ..... B65H 63/02

[52] U.S. Cl. ..... 242/37 R

[58] Field of Search ..... 242/37 R, 36, 39, 49, 242/28, 29, 30, 18 DD

[56] References Cited

U.S. PATENT DOCUMENTS

| | | | |
|---|---|---|---|
| 2,295,535 | 9/1942 | Abbott | 242/37 R |
| 2,367,768 | 1/1945 | Gibbs et al. | 242/37 R |
| 4,195,790 | 4/1980 | Reiners et al. | 242/37 R |

FOREIGN PATENT DOCUMENTS

| | | | |
|---|---|---|---|
| 627884 | 5/1963 | Belgium | 242/37 R |
| 912195 | 5/1954 | Fed. Rep. of Germany | 242/37 R |
| 957124 | 5/1964 | United Kingdom | 242/37 R |

*Primary Examiner*—Stanley N. Gilreath

*Attorney, Agent, or Firm*—Flynn, Thiel, Boutell & Tanis

[57] ABSTRACT

A swingable spool holder for a spool which can be driven on its periphery is controlled by a pneumatic drive device which can swing the spool holder between an operating position and a rest position. A compressed-air line is connected to the pneumatic drive device, and to a control valve which can be moved into two switching positions by a feeler lever which engages the thread which is to be wound up. A throttle valve which is effective in one direction is provided in the compressed-air line, which throttle valve is influenced by pressure in the compressed-air line so that it throttles the compressed-air supply to the pneumatic drive in one switching position of the control valve and, in another switching position, permits the rapid escape of compressed-air from the pneumatic drive device into the compressed-air line. An arrangement cooperable with the pneumatic drive device and an operating rod which acts onto the spool holder effects a no-load stroke of the drive device of a predetermined length before the operating rod is moved by the drive device.

7 Claims, 3 Drawing Figures

10A
10
9.
8
7
11
35
16C
29
34
28
27
16B
6A
37
A
25A
31
26
36
23
25
6.
16D
32
33
30
24
4
5
F
16A
23A
22
21
19
20
17
12
16
18
3
F
15
1
14
13A
13
COMPRESSED AIR SOURCE
50

33
31
16D
34
36

PNEUMATIC DRIVE FOR A SWINGABLE SPOOL HOLDER

FIELD OF THE INVENTION

This invention relates to a control device for a swingable spool holder which rotatably supports a spool which is driven at its periphery and, more particularly, to such a device which includes a pneumatic drive device for swinging the spool holder between an operating position and a rest position, a compressed-air line which is connected to the pneumatic drive device and to a control valve which is connected in front of the compressed-air line, can be moved into two switching positions by a feeler lever which engages the thread which is to be wound up, and connects the compressed-air line to a vent hole in its first switching position and to a compressed-air source in its second switching position.

BACKGROUND OF THE INVENTION

In such a known device for controlling a swingable spool holder (see German Pat. No. 29 31 344), there is provided as a pneumatic drive device a bellows which can be expanded with compressed air. If a thread breakage occurs, then the feeler lever swings and moves the control valve into its second switching position. Through this, the compressed-air line is directly connected to the compressed-air source and compressed air flows into and expands the bellows, so that it lifts the spool holder. Through this, the spool is lifted from the friction roller. Since the friction roller no longer drives the spool, the spool stops rotating. Particularly in the case of a slow winding speed, the end of the broken thread is not completely wound up onto the spool before the spool stops rotating. Moreover, the loose thread end is sometimes caught by the rotating friction roller and wound onto the friction roller, causing thread to be unwound from the spool and wound onto the friction roller. Aside from the loss of thread which occurs through this and the necessity of removing the thread manually from the friction roller, this also often leads to machine damage and thus to expensive idle time.

In another conventional pneumatic device for swinging the spool holder (see German Offenlegungsschrift No. 23 51 311), the pneumatic drive device has a piston which is movable in a cylinder and, when biased by compressed air, can be connected by a clamping device to an operating rod which is in turn pivotally connected to the spool holder. The clamping device is arranged on an intermediate member, relative to which the piston is initially axially freely movable, the piston thereafter engaging the intermediate member and carrying it along. With this device, it is supposed to be achieved that the spool holder, for any diameter spool, is always lifted by the same amount. This amount corresponds with the amount of movement of the intermediate member, which can be varied by adjustable stops. In this known device, the piston moves for a certain axial distance before it moves the operating rod. Since, however, the piston is biased with the full pressure of the compressed-air line, the time period from the application of pressure to the point in time at which the piston moves the operating rod is very short. This short time period is not sufficient to ensure a complete winding up of the loose thread end on the spool.

A basic purpose of the invention is therefore to provide a drive for a swingable spool holder of the above-mentioned type, in which a delay of the lifting of the spool from the friction roller is provided to ensure a complete winding up of the loose thread end onto the spool before the spool stops rotating.

SUMMARY OF THE INVENTION

This purpose is attained according to the invention by providing a throttle valve in the compressed-air line which is effective in one direction and which is influenced by the pressure which exists in the compressed-air line such that it throttles the compressed-air supply to the pneumatic drive device in the second switching position of the control valve and, in the first switching position, does not hinder the escape of the compressed air from the pneumatic drive device into the compressed-air line; and in addition by providing an arrangement between the pneumatic drive device and an operating rod cooperable with the spool holder which effects a no-load stroke of the drive device of a predetermined length before the operating rod is engaged and moved by the drive device.

Through the provision of the throttle valve which is effective in one direction, it is achieved that the compressed-air supply to the pneumatic drive device occurs relatively slowly following a thread breakage. However, this measure by itself would not necessarily be sufficient to attain the basic purpose of the invention, because the lifting off of the spool, even though slowed down, would start immediately upon a thread breakage, whereby only a slightly longer time would lapse before the spool is lifted from the friction roller. Therefore, according to the invention, there is in addition an arrangement which is provided between the operating rod and the drive device to permit a certain no-load stroke of a predetermined size. Based on this no-load stroke, the pneumatic drive device initially undergoes a movement over a certain time period without carrying along the operating rod. Since this time period is extended as a result of the throttled compressed-air supply, a time delay between the thread breakage and the point in time at which the spool is lifted from the friction roller occurs. Within this delay time interval, the loose end of the broken thread is wound up completely onto the spool, and the disadvantages of the known devices are eliminated.

BRIEF DESCRIPTION OF THE DRAWINGS

The invention is discussed in greater detail hereinafter in connection with an exemplary embodiment which is illustrated in the drawings, in which.

Figure 1:
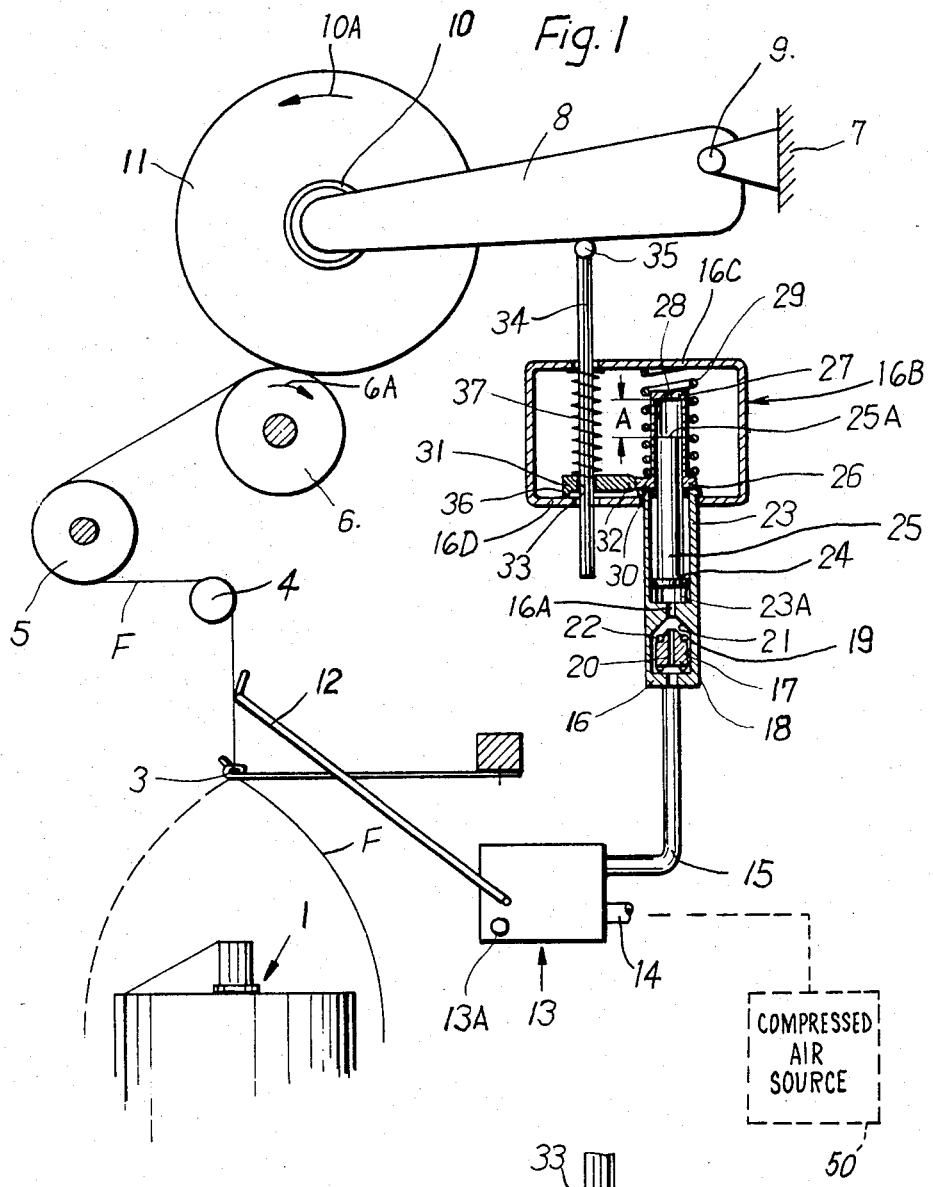
FIG. 1 is a sectional side view of a spool holder control system embodying the invention and showing the spool holder in a normal operating position.

The invention is described in detail herein in connection with a double-wire twisting machine. The inventive spool holder control system, however, can also be used on many other textile machines, for example a winding machine.

DETAILED DESCRIPTION

A thread F (FIG. 1) which comes from the double-wire twisting spindle 1 runs through a stationary thread guide 3 and is thereafter guided over two rotatably supported guide rollers 4 and 5. A friction roller 6 supported for rotation about a stationary axis extends the entire length of the machine and is driven in the direction of arrow 6A. An elongate spool holder 8 has one end supported pivotally on a stationary axle 9 which extends longitudinally of the machine and is supported on the machine frame 7. The spool holder 8 rotatably supports at its other end a spool sleeve 10. At the start of a winding-up operation, the spool sleeve 10 engages the friction roller 6 and is rotated in the direction of arrow 10A due to its engagement with the friction roller 6. Through this, a spool or winding 11 of the thread F is formed which, during the winding-up operation, progressively increases in diameter.

To monitor the thread F, a thread feeler lever 12 is provided which engages the thread F and controls a control valve 13. The control valve 13 is connected by a tubular line 14 to a conventional source 50 of compressed air and has furthermore a vent or exhaust hole 13A. The control valve 13 is furthermore connected through a tubular line 15 to a housing 16. The housing 16 has a cylindrical chamber or recess 17 therein in which a cylindrical piston or valve member 18 is supported for movement in an axial direction. Between the valve member 18 and the cylindrical recess 17 there is an annular gap or space 19, the cross-sectional area of which is approximately the same as the cross-sectional area of the opening through the compressed-air line 15. The valve member 18 has a relatively small central axial throttle bore 20 therethrough and has an annular seal 22 at its upper end which can engage a frustoconical valve seat 21 provided at the upper end of the recess 17.

Just above the cylindrical recess 17, the housing 16 has a cylindrical chamber or recess 23 in which a piston 24 is axially movably supported. The recesses 17 and 23 are connected by a passageway 16A which has a diameter significantly greater than that of the throttle bore 20.

The piston 24 is fixedly connected to a piston rod 25 which is movably supported in an intermediate member 26 which in turn is disposed in a chamber defined by housing part 16B. The intermediate member 26 is a tubular cylinder with an upper end wall 27, a cylindrical central opening 28 and a radially outwardly projecting flange 30 at its lower end. The intermediate member 26 is held in an initial position which is illustrated in FIG. 1 by a helical compression spring 29, the ends of which engage flange 30 and top wall 16C of housing part 16B. The arrangement is such that, in the initial position of the intermediate member 26, the free upper end 25A of the piston rod 25 is spaced a distance A from the end wall 27.

Figure 2:
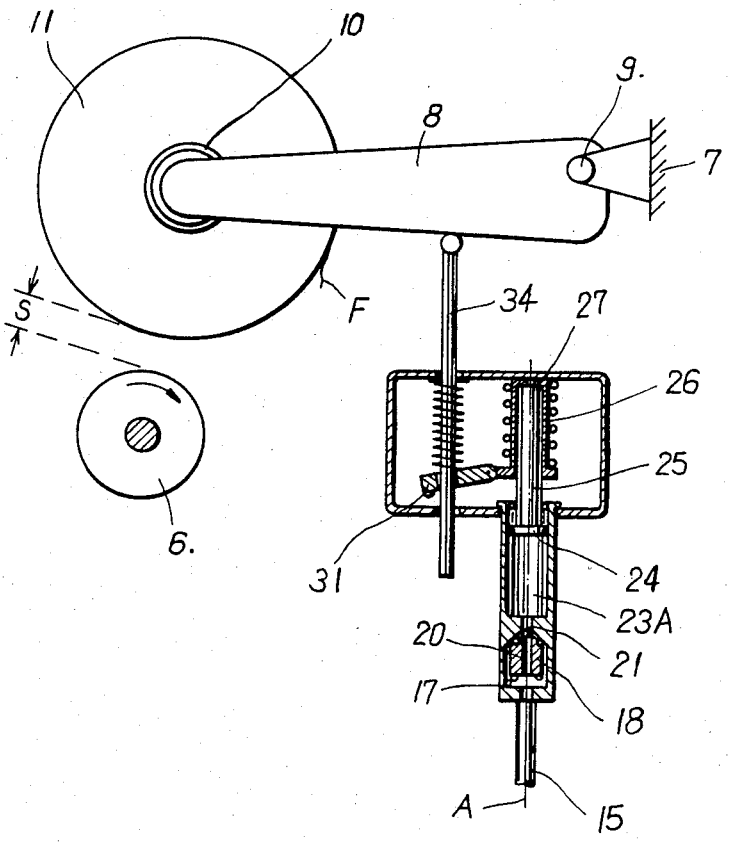
FIG. 2 is a sectional side view similar to FIG. 1 showing the spool holder in a lifted position.

A clamping plate 31 is supported on the flange 30 for pivotal movement about a horizontal axis 32 which extends perpendicular to the common axis A (FIG. 2) of the piston 24 and the cylinder 26, and perpendicular to the plane of the drawings. The clamping plate 31 has a vertical bore 33 therethrough, through which an operating rod 34 is slidably guided. The operating rod 34 extends parallel to the common axis A. The diameter of the bore 33 in the clamping plate 31 is slightly larger than the diameter of the operating rod 34. The diameter of the bore 33 must be sufficiently large so that the clamping plate 31 can be tilted with respect to the operating rod 34 during movement of the cylinder 26, which causes an upper edge portion and a lower edge portion of the ends of the bore 33 to engage the operating rod 34 and thus clamp the operating rod against movement relative to plate 31. The upper end of the operating rod 34 is pivotally connected by a joint 35 to the spool holder 9 at a location spaced from axle 9.

Figure 1A:
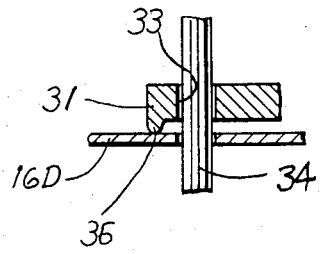
FIG. 1A is an enlarged view of a portion of FIG. 1.

The arrangement is such that the clamping plate 31 is held, in the initial position of the member 26 shown in FIG. 1, by a projecting stop 36 (FIGS. 1 and 1A) which engages bottom wall 16D of housing part 16B in a position in which bore 33 is radial with rod 34 and thus permits free axial movement of the operating rod 34 with respect to the clamping plate 31. Furthermore, a helical compression spring 37 with a relatively small spring force is provided around rod 34 to press the clamping plate 31 into its clamping position as described below, one end of spring 37 engaging clamping plate 31 and the other end engaging wall 16C.

During a normal thread winding operation, the described parts assume the positions illustrated in FIG. 1. Since the diameter of the spool 11 enlarges during winding up of the thread F onto sleeve 10, the spool holder 8 is slowly swung upwardly and carries along the operating rod 34. The carrying along of the operating rod 34 is in no way hindered by the clamping plate 31, since the axis of the bore 33 extends at this time approximately parallel to the axis of the operating rod 34 and the bore diameter is larger than the diameter of the operating rod. The compressed-air line 15 is pressureless, since the control valve 13 is held in a first switching position by the feeler lever 12, which engages the tensioned thread F, in which switching position the compressed-air line 15 communicates directly with the vent hole 13A.

In the event of a thread breakage, the thread F is no longer tensioned in the region of the feeler lever 12 and the feeler lever therefore is not supported and falls downwardly. Through this, it moves the valve 13 to a second switching position in which the compressed-air line 15 is connected to the line 14 and thus to the compressed-air source 50. Compressed air flows through the line 15 and into the cylindrical recess 17, causing the pistonlike valve member 18 to be moved upwardly and to engage the valve seat 21 with its seal 22. The compressed air can now flow into the cylindrical chamber 23 which is below the piston 24 only through the throttle bore 20. Through this, the piston 24 and the piston rod 25 are lifted slowly, and without such movement being transmitted to the operating rod 34. The spool 11, after a thread breakage thus continues to engage the friction roller 6 and be rotated by same. Through this, the thread F, regardless of where it is broken, continues to be wound onto the spool 11 until also its loose end is wound on the spool. In the meantime, the piston 24 and the piston rod 25 are lifted sufficiently far so that the upper end 25A of rod 25 engages the end wall 27 of the member 26. The member 26 is thereafter moved upwardly by the piston rod 25 against the force of spring 29. The clamping plate 31 is at the same time moved upwardly. Through this, the clamping plate 31 is pivoted downwardly about axis 32 under the urging of spring 37, and portions of the upper edge and the lower edge of the bore 33 move into engagement with the operating rod 34. As soon as these edges engage the operating rod 34, the clamping plate 31 is clamped against vertical movement with respect to the operating rod 34, and thus the latter is thereafter moved upwardly with member 26. The movement of operating rod 34 swings the spool holder 8 upwardly into the position illustrated in FIG. 2, in which the spool 11 and friction roller 6 are spaced. This upward swinging movement is limited by engagement of end wall 27 of the cylinder 26 with top wall 16C of the housing part 16B. Since the operating rod 34, during the normal winding-up operation and prior to a thread breakage, can move freely relative to the clamping plate 31, the distance S by which the spool 11 is spaced from the friction roller 6 is always substantially the same size.

After a renewed threading of the thread and tying together of the two thread ends, the feeler lever 12 is swung back upwardly into its original position, which is illustrated in FIG. 1. Through this, the control valve 13 is again moved into its first switching position. Compressed air in the line 15 can now escape to the outside through the valve and vent hole 13A. The compressed air in the cylindrical chamber 23A presses valve member 18 downwardly, which causes seal 22 to move away from valve seat 21. Since the annular gap 19 has a cross-sectional area which approximately corresponds with that of the compressed-air line 15, the air in chamber 23A can now escape unhindered and the spool holder 8 and spool 11 can swing without delay back into their normal operating positions. More specifically, the piston 24, rod 25 and member 26 descend as the air exits chamber 23A, and clamping plate 31 and rod 34 descend until clamping plate 31 is pivoted back to the position of FIG. 1 and the clamping between the clamping plate 31 and the operating rod 34 is released.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a control arrangement for a pivotally supported spool holder which rotatably supports a spool which can be rotationally driven by contact between its periphery and a surface on a moving friction member, including pneumatic drive means for selectively swinging said spool holder between an operating position and a rest position in which said periphery of said spool is respectively engaging and spaced from said surface on said friction member, and a compressed-air line which is connected to said pneumatic drive means and to a control valve, said control valve having a vent hole and having a feeler lever which can be moved between first and second switching positions and which engages a thread which is to be wound up on said spool, wherein when said feeler lever is in said first switching position said control valve connects said compressed-air line with said vent hole and wherein when said feeler lever is in said second switching position said control valve connects said compressed-air line to a compressed-air source, the improvement comprising throttle valve means for controlling air flow through said compressed-air line, said throttle valve means being responsive to air flow in said compressed-air line for restricting the flow of compressed air therethrough in a direction toward said pneumatic drive means and for permitting a rapid flow of compressed air therethrough in a direction away from said pneumatic drive means, said pneumatic drive means having a movably supported piston member which moves away from an initial position in a direction of movement at a predetermined speed as compressed air is supplied to said pneumatic drive means through said throttle valve means and said compressed-air line, and including clamping means cooperable with said pneumatic drive means and with a movably supported operating rod which is operatively coupled to said spool holder for permitting said piston member to move a predetermined distance in said direction of movement relative to said operating rod and for thereafter causing said operating rod to be operatively coupled to and to be moved in said direction of movement by said piston member.

2. The control arrangement according to claim 1, wherein said throttle valve means includes housing means defining a chamber having a valve seat therein, and includes a valve member which is supported in said chamber for movement relative to said valve seat, said valve member having a relatively small central throttle bore therethrough.

3. The control arrangement according to claim 2, wherein said valve member is a piston and said chamber is a cylindrical recess in said housing means, and wherein an annular gap is provided between said valve member and an inwardly facing surface of said recess, the cross-sectional area of said annular gap being approximately equal to the cross-sectional area of the passageway provided through said compressed-air line.

4. The control arrangement according to claim 1, wherein said clamping means includes a movably supported intermediate member, said piston member moving said predetermined distance in said direction of movement relative to said intermediate member and thereafter engaging said intermediate member and moving said intermediate member in said direction of movement, wherein said intermediate member is a cylindrical sleeve which is provided with an end wall and slidably receives a piston rod which is part of said piston member, and wherein in said initial position of said piston member a free end of said piston rod is spaced from said end wall of said sleeve, said free end of said piston rod engaging said end wall of said sleeve when said piston member has moved said predetermined distance from its initial position.

5. The control arrangement according to claim 4, wherein said operating rod extends approximately parallel to a common axis of said piston member and said sleeve, wherein said clamping means includes a clamping plate which is supported on said sleeve for pivotal movement about a swivel axis which extends approximately perpendicular to said common axis, and wherein said operating rod is slidably guided through a bore provided through said clamping plate, the diameter of said bore being slightly larger than the diameter of said operating rod so that, upon movement of said sleeve, said clamping plate pivots away from an initial position thereof and edges of said bore clampingly engage said operating rod.

6. The control arrangement according to claim 5, wherein said clamping means includes means for holding said clamping plate, in an initial position of said sleeve, in said initial position thereof; and wherein when said clamping plate is in its initial position, said clamping plate permits free movement of said operating rod relative to said clamping plate.

7. The control arrangement according to claim 6, wherein said means for holding said clamping plate includes first resilient means for yieldably urging said clamping plate toward its initial position and second resilient means for yieldably urging said sleeve toward its initial position.

* * * * *